US005104454A

United States Patent [19]

Yokozawa et al.

[11] Patent Number: 5,104,454

[45] Date of Patent: Apr. 14, 1992

[54] CLEANING METHOD AND AN APPARATUS THEREOF

[75] Inventors: Michinori Yokozawa; Hideaki Kikuchi, both of Shimizu, Japan

[73] Assignee: Du Pont - Mitsui Fluorochemicals Co. Ltd., Tokyo, Japan

[21] Appl. No.: 168,886

[22] Filed: Mar. 15, 1988

[51] Int. Cl.[5] ..... B08B 3/08

[52] U.S. Cl. ..... 134/11; 134/15; 134/22.19; 134/31; 134/38; 134/40; 134/109; 134/122 R

[58] Field of Search ..... 134/40, 39, 42, 10, 134/11, 38; 252/171, 162, DIG. 9, 127

[56] References Cited

U.S. PATENT DOCUMENTS

| | | | |
|---|---|---|---|
| 4,341,567 | 7/1982 | Roehl | 134/40 |
| 4,442,851 | 4/1984 | Holm | 134/106 |
| 4,486,239 | 12/1984 | du Fresne | 134/40 |
| 4,605,027 | 8/1986 | Dallot | 134/108 |

*Primary Examiner*—Anthony McFarlane
*Attorney, Agent, or Firm*—Cushman, Darby & Cushman

[57] ABSTRACT

The cleaning method of the present invention comprises; (a) immersing a material to be cleaned in a mixed solvent contained in the first open vessel, wherein the mixed solvent consists of a chlorofluoro-hydrocarbon with a boiling point of 20°-50° C. and an organic solvent with a boiling point of 50° C. or more higher than that of said chlorofluoro-hydrocarbon and compatible therewith, but not azeotropic therewith, and kept at a temperature within a range between the boiling point of the chlorofluoro-hydrocarbon and a temperature of at least 30° C. lower than the boiling point of the organic solvent, (b) then transferring the material into a boiling liquid essentially consisting of said chlorofluoro-hydrocarbon contained in the second open vessel, (c) and taking out the material from the boiling liquid, (d) wherein, constituting a saturated vapor zone of the chlorofluoro-hydrocarbon by the evaporated vapor from the boiling liquid essentially consisting of the chlorofluoro-hydrocarbon and the mixed solvent in an open container equipped with cooling apparatus in the upper part and holding the open vessels in the lower part, (e) and keeping a constant state of the ratio of the chlorofluoro-hydrocarbon and the organic solvent in the mixed solvent, with a equilibrium of the evaporation of the chlorofluoro-hydrocarbon from the mixed solvent and its absorption from the saturated vapor zone of the chlorofluoro-hydrocarbon, by keeping the temperature of the mixed solvent at a constant temperature.

2 Claims, 1 Drawing Sheet

CLEANING METHOD AND AN APPARATUS THEREOF

FIELD OF THE INVENTION

The present invention relates to a cleaning method and an apparatus thereof, more particularly, to a method and an apparatus to clean efficiently oil components and the like stained on the surface of metals or electronic materials with the application of solvents.

DESCRIPTION OF THE PRIOR ART

Oil components and the like stained on the surface of metals or electronic materials are usually removed with the application of solvent such as hydrocarbons, but such hydrocarbon solvent has a problem of flammability and toxicity in general.

The diffusion of the vapor of the toxic or flammable solvent into the atmosphere is mainly caused by the evaporation of the solvent from an open vessel containing the solvent used for the cleaning and the residual solvent wetting the material already cleaned and taken out.

Chlorinated hydrocarbon may be non-flammable, but more toxic.

As a less-toxic and non-flammable solvent, chlorofluoro-hydrocarbon such as trichlorotrifluoroethane (Flon-113) has been already known as a significantly good solvent and has been used widely, but still some of the stains are hardly removable except using a solvent with higher boiling point at higher temperature.

SUMMARY OF THE INVENTION

It is an object of the present invention to provide an improved cleaning method and an apparatus thereof, by utilizing the combined characteristics of two kinds of solvents, one is an organic solvent having a higher boiling point which means a relatively higher cleaning power but may have more toxicity and flammability and another is a chlorofluoro-hydrocarbon with a boiling point of 20°-50° C., which means a relatively lower cleaning power, but less-toxicity and non-flammability.

DETAILED DESCRIPTION OF THE PREFERRED EMBODIMENTS

Figure 1:
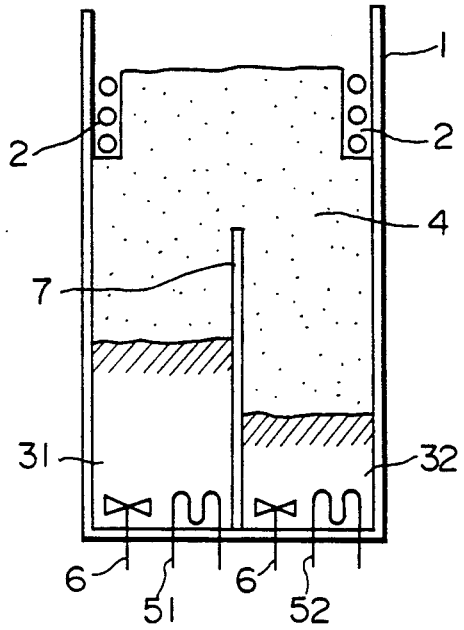
FIG. 1 is to illustrate the basic embodiment of the present invention, in which two open vessels are equipped at the lower part of the container(1) of the cleaning apparatus.

The cleaning method of the present invention comprising:

(a) immersing a material to be cleaned in a mixed solvent contained in the first open vessel, wherein the mixed solvent consists of a chlorofluoro-hydrocarbon with a boiling point of 20°-50° C. and an organic solvent with a boiling point of 50° C. or more higher than that of said chlorofluoro-hydrocarbon and compatible therewith, but not azeotropic therewith, and kept at a temperature within a range between the boiling point of the chlorofluoro-hydrocarbon and a temperature of at least 30° C. lower than the boiling point of the organic solvent, (b) then transferring the material into a boiling liquid essentially consisting of said chlorofluoro-hydrocarbon contained in the second open vessel, (c) and taking out the material from the boiling liquid essentially consisting of the chlorofluoro-hydrocarbon, (d) wherein, constituting a saturated vapor zone of the chlorofluoro-hydrocarbon by the evaporated vapor from the boiling liquid essentially consisting of the chlorofluoro-hydrocarbon and the mixed solvent in an open container equipped with cooling apparatus in the upper part and holding the open vessels in the lower part, (e) and keeping a constant ratio of the chlorofluoro-hydrocarbon and the organic solvent in the mixed solvent, with a equilibrium of the evaporation of the chlorofluoro-hydrocarbon from the mixed solvent and absorption of the chlorofluoro-hydrocarbon from the saturated vapor zone of the chlorofluoro-hydrocarbon, by keeping the temperature of the mixed solvent constant.

It is preferable to equip three or more open vessels in the lower part of the container. The first open vessel containing the mixed solvent can be equipped in two or more stages and used in series for the first step cleaning, and in the same manner, the second open vessel containing the boiling liquid essentially consisting of the chlorofluoro-hydrocarbon can be equipped in two or more stages and used in series for the second step cleaning.

However, it is more preferable to equip the third open vessel which contains a liquid essentially consisting of the chlorofluoro-hydrocarbon kept at a temperature under the boiling temperature thereof.

In this case, the material to be cleaned is immersed into the mixed organic solvent for the first step cleaning, then transferred into the boiling liquid essentially consisting of the chlorofluoro-hydrocarbon for the second step cleaning, and successively into the liquid essentially consisting of the chlorofluoro-hydrocarbon kept at lower temperature than its boiling point for the third step cleaning, then taking out to be cleaned with the vapor in the saturated vapor zone of the chlorofluoro-hydrocarbon as the fourth step cleaning. Thus, it is possible to get more improved cleaning effect and interrupt the diffusion of the vapor of the organic solvent with high boiling point into the atmosphere.

Practical embodiments of the present invention will be explained using the attached drawings hereunder:

The open container(1) has an enough depth with an opened top, wherein cooling apparatus(2) is equipped in the upper part at a position which does not obstruct the operation of putting in and taking out of the materials to be cleaned.

Figure 2:
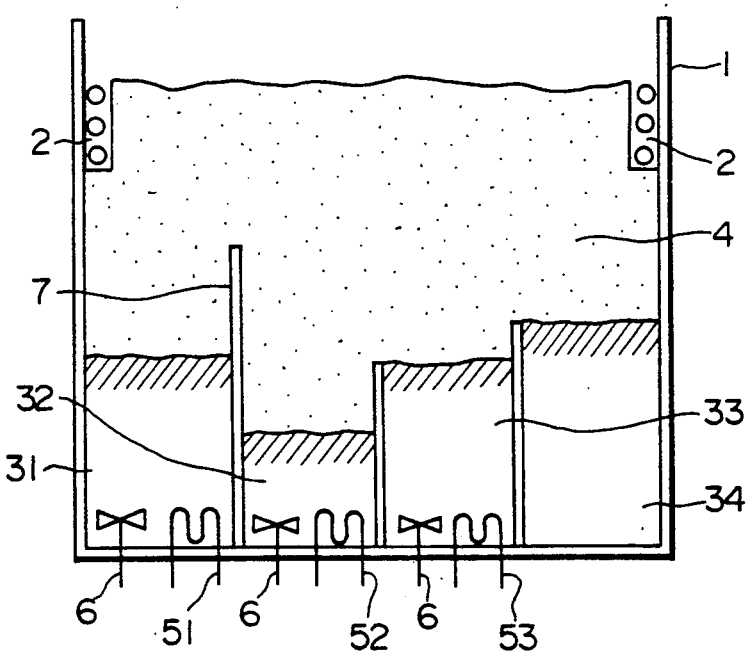
FIG. 2 is to illustrate a preferable embodiment of the present invention, in which four open vessels are equipped in the lower part of the container(1).

In the lower part of the open container(1), plural number of open vessels are equipped, for example, two open vessels (31) and (32) in FIG. 1, and four open vessels (31), (32), (33) and (34) in FIG. 2.

The first open vessel(31) contains the mixed solvent of the chlorofluoro-hydrocarbon (heretofore called "the first solvent") with a boiling point of 20°-50° C. and the organic solvent (heretofore called "the second solvent") with a boiling point of 50° C. or more higher than that of the first solvent and compatible with the first solvent but not azeotropic, and it is equipped with a heater(51) to keep the temperature of the mixed solvent at an appropriate temperature within a range between the boiling point of the first solvent and a temperature of at least 30° C. lower than that of the second solvent and a stirrer(6).

The second open vessel(32) contains a boiling liquid essentially consisting of the first solvent and equipped with a heater(52) to keep the liquid in ebullition.

The liquid level of the first open vessel(31) varies depending upon the temperature of it, as the solubility of the first solvent in the mixed solvent is affected thereby. So, it is desirable to install a partition(7) with a height not to reach the position of the cooling apparatus(2) between the first and second open vessels, so as to interrupt the overflow of the mixed solvent in the first open vessel(31) and the vapor of the second solvent evaporated from the first open vessel into the second open vessel(32).

Otherwise, an apparatus (not shown in the Figures) to transfer the overflowed liquid into other auxiliary vessel may be attached.

The reason why the height of the partition(7) is designed so as not to reach to the position of cooling apparatus(2) is that the top of the partition should be located within the saturated vapor zone(4) of the first solvent generated in the space between the cooling apparatus(2) and a group of those open vessels, where material to be cleaned is transferred from the first open vessel to the second open vessel, remaining within the saturated vapor zone(4) of the first solvent.

This partition will also play a role of interrupting the vapor of the second solvent evaporated from the first open vessel(31) to transfer to the second open vessel(32) and so on.

It is furthermore desirable to keep the temperature of upper part of the first open vessel(31) above the boiling point of the first solvent and under the temperature of the mixed solvent in the first open vessel, by placing a cooler at the side wall of the first open vessel(31), so as to interrupt the overflow of the vapor of the second solvent evaporated from the mixed solvent over the partition(7).

The second open vessel(32), the third open vessel(33) and the fourth open vessel(34) shown in FIG. 2 are used to contain the liquid essetially consisting of the first solvent.

In the case of FIG. 2, the temperature of the second open vessel(32) and the third open vessel(33) are kept at the boiling temperature of the first solvent and that of the fourth open vessel(34) is kept under the boiling point of the first solvent.

In the case of equipping three open vessels (32), (33) and (34) respectively containing the liquid essentially consisting of the first solvent, it is desirable to arrange them so as to the liquid level of the third open vessel(33) is higher than that of the second open vessel(32) and the liquid level of the fourth open vessel(34) is higher than that of the third open vessel(33), and the overflowed liquid from the fourth open vessel(34) to flow into the third open vessel(33), and the overflowed liquid from the third open vessel(33) to flow into the second open vessel(32).

As explained heretofore, the first open vessel(31) contains the mixed solvent of the first solvent and the second solvent, and the second open vessel(32) (also the third open vessel(33) and the fourth open vessel(34) in the case of FIG. 2) contains the first solvent essentially.

By heating the second open vessel(32) with the heater(52), the first solvent therein reaches to the boiling state and begins to evaporate. As the density of the first solvent is greater than that of the air (for example: the saturated vapor density of Flon-113 is about 7.4 grams/-liter: the density of the air at room temperature is about 1.3 grams/liter), the vapor of the first solvent fills the space in the open container(1).

The vapor which tends to go upward through the open top of the container(1) is cooled by the cooling apparatus(2) equipped in the upper part of the open container(1) and liquefies to drop down to the open vessels. In this manner, a saturated vapor zone(4) of the first solvent is formed in the space between the cooling apparatus(2) and a group of open vessels, and little quantity of the first solvent leaks to the atmosphere from the opened top of the open container(1).

The heat quantity given to the second open vessel(32) (in the case of FIG. 2, total heat quantity given to the second and the third open vessels) should be in proper quantities to maintain the saturated vapor zone(4) between the cooling apparatus(2) and a group of open vessels in the open container(1). Excess heat quantity given to the second (and the third) open vessel brings heavy burden on the cooling apparatus(2).

The saturated vapor zone(4) has the temperature of about the boiling point of the first solvent and forms a uniform vapor-seal around the space between the cooling apparatus(2) and a group of open vessels (the first open vessel(31) and the second open vessel(32) in FIG. 1 and still more the third open vessel(33) and the fourth open vessel(34) in FIG. 2).

The first open vessel(31) containing the mixed solvent of the first and second solvents, placed in the saturated vapor zone(4) of the first solvent thus generated, is kept at a temperature between the boiling point of the first solvent and a temperature of at least 30° C. lower than the boiling point of the second solvent.

As the result, the ratio of the first and the second solvent in the mixed solvent will be kept at an equilibrium value corresponding to the temperature thereof, by the evaporation of the first solvent from the mixed solvent and the absorption of the first solvent in the saturated vapor zone(4).

Therefore, it is possible to maintain the ratio of the first and the second solvent in the mixed solvent to a proper value to dissolve stains on the materials to be cleaned most effectively, by only keeping the temperature of the mixed solvent at a temperature corresponding to the desired ratio.

According to the present invention, it is possible to keep the mixed ratio of the solvents in the first open vessel(31) at a proper value for a long period of time, and can realize a stable cleaning operation.

It is desirable to keep the temperature of the first open vessel(31) as stable as possible, but there is no problem to have a little fluctuation of the temperature, so far as within the range not to affect bad influence on the stability of the cleaning operation.

The vapor of the second solvent evaporated from the mixed solvent in the first open vessel(31) is immediately contacted with the saturated vapor zone(4) of the first solvent, the temperature of which is 50° C. or more lower than the boiling point of the second solvent, most of the vapor of the second solvent liquefies and drops down into the first open vessel(31) and little of the vapor of the second solvent will diffuse into the atmosphere from the opened top of the container(1) through the saturated vapor zone(4).

Thus, even when a toxic or flammable solvent is used as the second solvent at a high temperature, it may be kept away from evaporating and diffusing into the air and the danger of inflammation during the operation or toxic problem in the working environment will be averted.

The mixing of the second solvent liquefied in the saturated vapor zone(4) into the second open vessel(32) and so on containing the first solvent is not a problem since the mixing of the second solvent into the first solvent in the second open vessel(32) is negligible because the first open vessel(31) is just warmed state and on the other hand the second open vessel(32) is in ebullition.

If a solvent with the boiling point of less than 50° C. difference from that of the first solvent was used as one component of the mixed solvent in the first open vessel, it might increase the mixing possibility of the second solvent into the second open vessel(32) and so on, but it was confirmed by an experiment that practically negligible amount of the second solvent transferred into the second open vessel(32) and so on, when the second solvent with the boiling point of more than 50° C., preferably more than 70° C. difference was used.

In the cleaning method of the present invention, the material to be cleaned is immersed into the mixed solvent in the first open vessel(31), and successively into the first solvent in the second open vessel(32) kept in ebullition.

All the stains attached to the material can be dissolved and removed mostly by the mixed solvent in the first open vessel(31).

If necessary, two or more open vessels containing the mixed solvent may be equipped and used one after another for the cleaning of the material.

Additional cleaning can be done by the first solvent in the second open vessel(32) and so on.

As the second solvent remained on the surface of the material taken out of the first open vessel(31) is rinsed by the first solvent in the second open vessel(32), the transferral of the second solvent remaining on the surface of the material into the air and the evaporation or diffusion of the second solvent into the air is interrupted, and as the result, the danger of inflammation during the operation and toxic problem in working environment is averted.

To make the rinse more perfectly, it is preferable to repeat the cleaning with the first solvent.

For example, as shown if FIG. 2, immerse the material to be cleaned into the mixed solvent in the first open vessel(31), into the boiling first solvent in the second open vessel(32) and the third open vessel (33) one after another, and more preferably into the first solvent kept under the boiling point in the fourth open vessel(34), where the temperature of the material is lowered and the material is submitted to vapor cleaning in the saturated vapor zone(4).

As explained above, when three open vessels for the first solvent are equipped, it is preferable to arrange them so as to the liquid level of the third open vessel(33) is higher than that of the second open vessel(32) and the liquid level of the fourth open vessel(34) is higher than that of the third open vessel(33), and the overflowed liquid from the fourth open vessel(34) to flow into the third open vessel(33), and the overflowed liquid from the third open vessel(33) to flow into the second open vessel(32) as shown in FIG. 2.

The liquid level of the fourth open vessel(34) would be raised by the recycling of the first solvent liquefied in the saturated vapor zone(4) of the first solvent, and the excess liquid overflows into the third open vessel(33), where the liquid level would be going up by joining it with the first solvent liquefied and recycled from the saturated vapor zone(4) of the first solvent and the excess liquid overflows into the second open vessel(32).

Thus, the second solvent dissolved out of the material during the rinse process is transferred from the fourth open vessel to the third, and then to the second with the overflowed liquid, by which the first solvent in the latter part of open vessels is kept in more pure state, and the material is rinsed more perfectly.

If necessary, there may be equipped two or more open vessels containing the first solvent kept in ebullition, or more open vessels containing the first solvent kept the temperature under the boiling point.

Depending upon the kinds of stains, the second open vessel(32) and so on may be equipped with a supersonic cleaning apparatus.

The first solvent which can be used in the present invention includes, trichlorofluoromethane (Flon-11), 1,1,2-trichloro-1,2,2,-trifluoroethane (Flon-113), 1,1-dichloro-2,2,2-trifluoroethane (Flon-123), 1,2-dichloro-1,1-difluoroethane (Flon-132b), 1,1-dichloro-2-fluoroethane (Flon-141b) etc. or those combinations.

Especially preferred as the first solvent are Flon-113 (boiling point; 47.6° C.) or Flon-132b (boiling point: 46.8° C.) with comparatively higher boiling point, less-toxic property and less flammability.

The second solvent which can be used in the present invention includes, mineral spirit or kerosene etc. as aliphatic hydrocarbons, butyl alcohol, amyl alcohol or hexyl alcohol etc. as alcohols, butyl ether, ethylene glycol alkyl ether (cellosolve), carbitol etc. as ethers or ether-alcohols, diisopropyl ketone, methyl amyl ketone, cyclohexanone etc. as ketones, butyl acetate, amyl acetate, cellosolve acetate etc. as esters, toluene, xylene, or cresol etc. as aromatic hydrocarbons or dipenthene, turpentine oil etc as terpenes.

As explained before, it was confirmed that the mixing of the second solvent into the second open vessel is practically negligible when the second solvent with a boiling point of 50° C. or more, preferably 70° C. or more higher than that of the first solvent is used.

It is more preferable to use the second solvent with the boiling point of higher than 120° C., desirably higher than 150° C., to broaden the selection range of the mixing ratio of the first and the second solvent in the mixed solvent contained in the first open vessel.

EXAMPLE 1

To confirm the flexibility of the setting up of the mixing ratio of the first solvent and the second solvent in the mixed solvent contained in the first open vessel by adjusting the temperature of the mixed solvent contained in the first open vessel, the following test was performed.

Flon-113 (boiling point: 47.6° C.), a chlorofluorohydrocarbon having a boiling point in the range of 20°-50° C., was used as the first solvent and isoamylbenzoate (boiling point: 262° C.) was used as the second solvent.

Mixed solvents (original mixing ratio is shown in Table 1) were prepared and contained in the first open vessel(31) of the apparatus shown in FIG. 2.

In the second open vessel(32), was contained Flon-113 in the boiling state. In the third and the fourth open vessels, were contained Flon-113 keeping the temperature of them under the boiling point.

The temperature of the mixed solvent in the first open vessel was adjusted in the range of 60°-100° C. and the composition of the mixed solvent was determined after stabilizing in the equilibrium state in the first open vessel, in which the solvent was kept stirring with a stirrer. The test result is shown in Table 1.

TABLE 1

| The first open vessel set up temperature | Flon-113 original concentrations | Flon-113 concentrations after equilibrium |
|---|---|---|
| 60° C. | 42.7 wt. % | 54.9 wt. % |
| 70° C. | 44.2 wt. % | 51.9 wt. % |
| 80° C. | 42.5 wt. % | 46.3 wt. % |
| 90° C. | 40.1 wt. % | 37.0 wt. % |
| 100° C. | 39.8 wt. % | 7.0 wt. % |

Furthermore, the concentration of the second solvent in the second open vessel was determined after reaching the equilibrium state. the result is shown in Table 2.

As shown in Table 2, it was confirmed that very little quantity of the second solvent was mixed into the first solvent in the second open vessel even in the equilibrium state.

TABLE 2

| The first open vessel set up temperature | The second open vessel concentration of isoamylbenzoate |
|---|---|
| 60° C. | not detected |
| 70° C. | not detected |
| 80° C. | not detected |
| 90° C. | 0.2 wt. % |
| 100° C. | 0.42 wt. % |

EXAMPLE 2

Same kinds of the first and the second solvents as used in Example 1 were used for an actual cleaning test and determined the change of the mixed solvent composition in the first open vessel and the cleaning effect during the lapse of cleaning time.

As a sample to be cleaned, a piece of iron coated evenly with hot melted wax was used.

Cleaning of the sample is performed by the following steps one after another:

The first open vessel; immersed the sample in warmed mixed solvent for two minutes.

The second open vessel; immersed the sample in the boiling first solvent for thirty seconds.

The third open vessel; immersed the sample in the boiling first solvent for thirty seconds.

The fourth open vessel; immersed the sample in the cool first solvent for thirty seconds.

Steam cleaned the sample in the saturated first solvent zone for thirty seconds.

The method for the measurement of the cleaning effect was as follows; adhering Scotch tape made by Sumitomo 3M Co. on the surface of the sample (iron piece) after the cleaning, pressing well over it with rubbing, stripping it out of the sample (iron piece) and checked it if stains were attached on the tape or not.

Test results are shown in Table 3.

TABLE 3

| Lapse of time (hr) | The first open vessel Temperature | Composition Flon-113 | Composition Isoamylbenzoate | Cleaning results |
|---|---|---|---|---|
| 0 | 19° C. | 42.5 wt. % | 57.5 wt. % | no good |
| 1 | 80° C. | 39.5 wt. % | 60.7 wt. % | good |
| 2 | 80° C. | 45.5 wt. % | 54.5 wt. % | good |
| 3 | 80° C. | 47.4 wt. % | 53.6 wt. % | good |

TABLE 3-continued

| Lapse of time (hr) | The first open vessel Temperature | Composition Flon-113 | Composition Isoamylbenzoate | Cleaning results |
|---|---|---|---|---|
| 4 | 80° C. | 48.0 wt. % | 52.0 wt. % | good |

It was confirmed that good cleaning results were achieved, when the liquid temperature of the mixed solvent in the first open vessel was kept at 80° C.

EXAMPLE 3

Using DBE (dibasic acid ester, made by DuPont Co., U.S.A. with the boiling point of 205° C.) as the second solvent, same kind of test as Example 2 was performed. The test result is shown in Table 4.

TABLE 4

| Lapse of time (hr) | The first open vessel Set up temperature | Composition Flon-113 | Composition DBE | Cleaning results |
|---|---|---|---|---|
| 0 | 12° C. | 32.6 wt. % | 67.4 wt. % | no good |
| 3 | 81° C. | 34.1 wt. % | 65.8 wt. % | good |
| 4 | 80° C. | 36.1 wt. % | 63.9 wt. % | good |
| 5 | 80° C. | 37.7 wt. % | 62.2 wt. % | good |

It was confirmed to get good cleaning results when the temperature of the first open vessel was kept at about 80° C.

EXAMPLE 4

The change of the second solvent concentration in the second open vessel in the equilibrium state was observed when the temperature difference between the temperature of the mixed solvent in the first vessel and the boiling temperature of the second solvent therein was altered.

A mixed solvent of Flon-113 and tetrachloroethylene (boiling point: 121° C.) was contained in the first open vessel and determined the concentration of tetrachloroethylene in the second open vessel when the solvent composition reached to the equilibrium state. Test results is shown in Table 5.

TABLE 5

| The first open vessel set up temperature | Temperature difference | The second open vessel Concentration |
|---|---|---|
| 60° C. | 61° C. | 0.2 wt. % |
| 70° C. | 51° C. | 0.3 wt. % |
| 80° C. | 41° C. | 0.4 wt. % |
| 90° C. | 31° C. | 0.6 wt. % |

It was found that the concentration of the second solvent in the second open vessel was less than 1 wt. %, when the difference of the temperature between the set up temperature of the mixed solvent and the boiling point of the second solvent therein was more than 30° C.

As explained heretofore, as the second solvent is used under the seal of the less-toxic and non-flammable chlorofluoro-hydrocarbon vapor, the second solvent can be used at a higher temperature without a problem of the leakage or diffusion of the second solvent into the atmosphere. So, according to the present invention, it is possible to accomplish a higher cleaning efficiency without a fear of poisoning or inflammation during the operation, even if the second solvent is a toxic or flammable one.

We claim:

1. A cleaning method carried out in a container open to the atmosphere and having a plurality of vessels located in a lower portion thereof wherein each vessel is in open vapor communication with each other and the container said method comprising:

(a) immersing a stained material in a mixed solvent contained in a first open vessel, wherein the mixed solvent consists essentially of a chlorofluoro-hydrocarbon with a boiling point of 20°–50° C. and an organic solvent with a boiling point of at least 50° C. higher than that of said chlorofluoro-hydrocarbon and in which the mixed solvents are, do not form an azeotropic mixture, and wherein said mixture is kept at a temperature within a range between the boiling point of the chlorofluoro-hydrocarbon and a temperature of at least 30° C. lower than the boiling point of the organic solvent, (b) then transferring the material into a boiling liquid consisting essentially of said chlorofluoro-hydrocarbon contained in a second open vessel, (c) and removing the material from the boiling liquid consisting essentially of the chlorofluoro-hydrocarbon, (d) forming saturated vapor zone of the chlorofluoro-hydrocarbon in an upper portion of the container and above the first and second vessels by the vapor evaporated from the boiling liquid consisting essentially of the chlorofluoro-hydrocarbon, and the mixed solvent; the open container being equipped with cooling apparatus in an upper part of the container, (e) and maintaining a constant ratio of the chlorofluoro-hydrocarbon and the organic solvent in the mixed solvent at a desired value that effectively dissolves stains on the material being cleaned, with an equilibrium of the evaporation of the chlorofluoro-hydrocarbon from the mixed solvent and its absorption from the saturated vapor zone of the chlorofluoro-hydrocarbon, by keeping the temperature of the mixed solvent substantially constant in the first open vessel.

2. A cleaning method carried out in a container open to the atmosphere and having a plurality of vessels located in a lower portion thereof wherein each vessel is in open vapor communication with each other and the container said method comprising:

(a) immersing a stained material in a mixed solvent contained in a first open vessel, wherein the mixed solvent consists essentially of a chlorofluoro-hydrocarbon with a boiling point of 20°–50° C. and an organic solvent with a boiling point of at least 50° C. higher than that of said chlorofluoro-hydrocarbon and in which the mixed solvents are, do not form an azeotropic mixture and wherein said mixture is kept at a temperature within a range between the boiling point of said chlorofluoro-hydrocarbon and a temperature of at least 30° C. lower than the boiling point of the organic solvent, (b) then transferring the material into a boiling liquid consisting essentially of said chlorofluoro-hydrocarbon contained in a second open vessel, (c) then transferring the material into a liquid consisting essentially of said chlorofluoro-hydrocarbon contained in a third open vessel and kept at a temperature under the boiling temperature thereof, (d) and removing the material from the liquid consisting essentially of said chlorofluoro-hydrocarbon, (e) forming a saturated vapor zone of the chlorofluoro-hydrocarbon in an upper portion of the container and above the first, second and third vessels by the vapor evaporated from the boiling liquid consisting essentially of the chlorofluoro-hydrocarbon; and the mixed solvent; the open container being equipped with cooling apparatus in an upper part of the container, (f) and maintaining a constant ratio of the chlorofluoro-hydrocarbon and the organic solvent in the mixed solvent at a desired value that effectively dissolves stains on the material being cleaned, with an equilibrium of the evaporation of the chlorofluoro-hydrocarbon from the mixed solvent and its absorption from the saturated vapor zone of the chlorofluoro-hydrocarbon, by keeping the temperature of the mixed solvent substantially constant in the first open vessel.

* * * * *